United States Patent [19]

Pigott et al.

[11] 4,283,931

[45] Aug. 18, 1981

[54] CONTINUOUS EXTRUSION OF METALS

[75] Inventors: Stanley W. Pigott, Haywards Heath; Peter Gregory, Great Missenden, both of England

[73] Assignee: BICC Limited, London, England

[21] Appl. No.: 61,995

[22] Filed: Jul. 30, 1979

[30] Foreign Application Priority Data

Oct. 27, 1978 [GB] United Kingdom ..... 42280/78
Jun. 14, 1979 [GB] United Kingdom ..... 20813/79

[51] Int. Cl.[3] ..... B21C 23/32

[52] U.S. Cl. ..... 72/45; 72/60; 72/262; 72/270

[58] Field of Search ..... 72/44, 41, 42, 43, 45, 72/60, 262, 270

[56] References Cited

U.S. PATENT DOCUMENTS

| | | | |
|---|---|---|---|
| Re. 28,795 | 5/1976 | Fuchs | 72/60 |
| 3,740,985 | 6/1973 | Fuchs | 72/60 |
| 3,765,216 | 10/1973 | Green | 72/262 |
| 3,922,898 | 12/1975 | Voorhes | 72/43 |
| 4,027,514 | 6/1977 | Moreau | 72/60 |
| 4,041,745 | 8/1977 | Moreau | 72/60 |

FOREIGN PATENT DOCUMENTS 1370894 10/1974 United Kingdom .
1488445 10/1977 United Kingdom .

OTHER PUBLICATIONS

The Reactor Group Report 2530 (S), United Kingdom Atomic Energy Authority, Apr. 1974, "Conform-a New Concept for Continuous Extrusion Forming of Metals", TRG Headquarters, Risley, Warrington, WA3 6AT.

The Reactor Group Report 2945 (S), United Kingdom Atomic Energy Authority, Apr. 1977, "The UKAEA 'Conform' Method of Continuous Extrusion Forming", TRG Headquarters, Risley, Warrington, WA3 6AT.

*Primary Examiner*—Lowell A. Larson
*Assistant Examiner*—Gene P. Crosby
*Attorney, Agent, or Firm*—Buell, Blenko, Ziesenheim & Beck

[57] ABSTRACT

An extrusion machine is disclosed wherein wax or other suitable lubricant is applied to the side of the feedstock contacting the shoe of the extruder. A stick of wax may be supported in a cylinder having an open end facing the feedstock; the stick is a loose sliding fit in the cylinder and compressed gas introduced into the cylinder applies a substantially constant biassing force urging the stick into engagement with the feedstock and at the same time, by leaking between the stick of lubricant and the cylinder, cools the stick of lubricant to inhibit melting.

3 Claims, 2 Drawing Figures

CONTINUOUS EXTRUSION OF METALS

Figure 1:
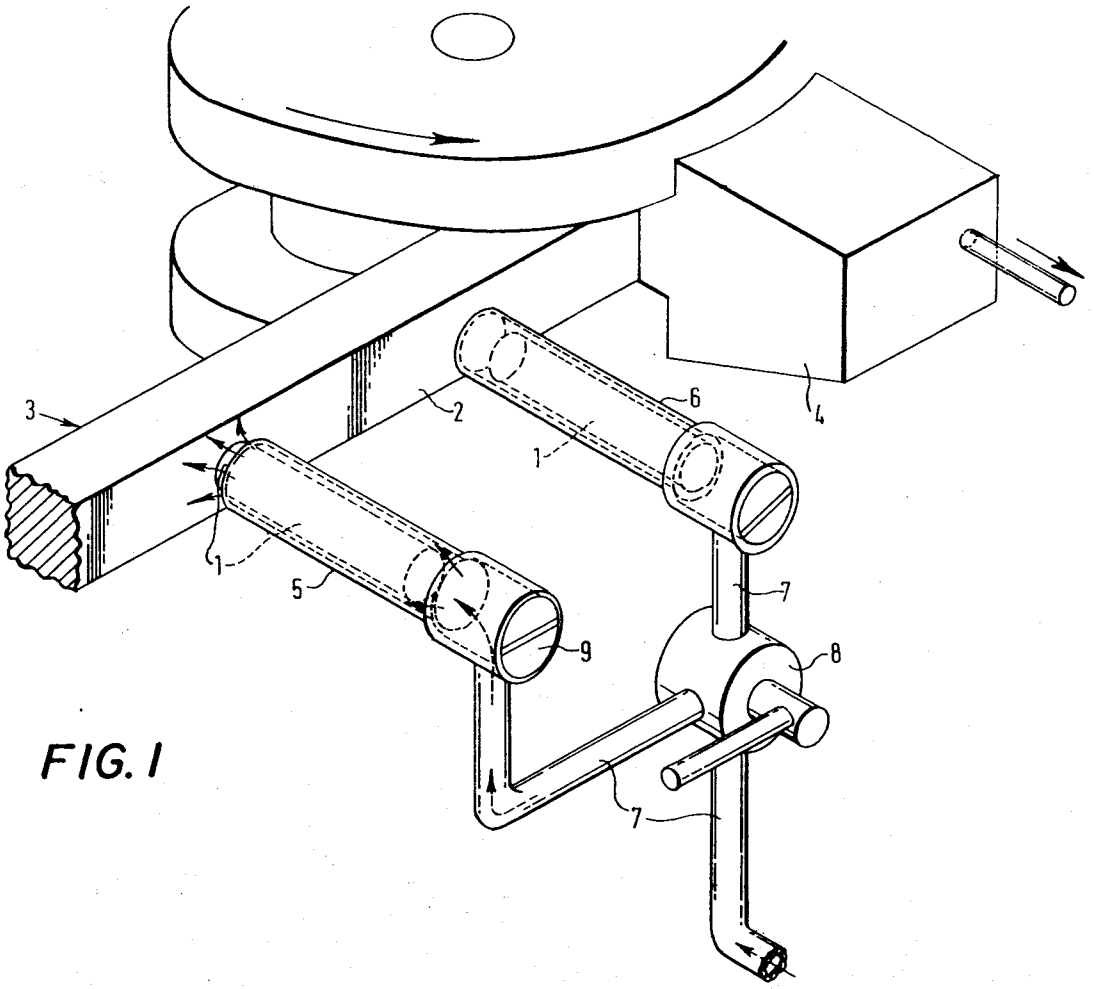

This invention relates to a method of and apparatus for the continuous friction-effected extrusion of metals (including alloys and composite extrudable workpieces consisting in part of metal or alloy).

UK patent specification No. 1370894 in the name of the United Kingdom Atomic Energy Authority describes a process and apparatus for this purpose, hereinafter called the Conform process and a Conform machine respectively, in which a rod feedstock is gripped in a channel formed between one moving surface defined by the walls of a groove in a rotatable wheel and one stationary surface defined by a shoe closing part of the circumference of the groove, the channel having a stop at the end towards which the moving surface travels, to advance the feedstock towards the stop and so develop a pressure in the feedstock greater than the yield strength of the material from which it is made so that it upsets against the stop and flows out through a die orifice extending through the stop or through the shoe adjacent to it.

In the operation of the Conform process, it is essential that the feedstock moves with respect to the shoe and remains in frictional engagement with the surface of the wheel groove; hitherto this has been ensured by making the contact area on the wheel considerably larger than the contact area on the shoe, and in some cases by coating the wheel groove with the feedstock material in order to promote adhesion.

In accordance with the present invention, a process for continuous friction-effected extrusion of rod feedstock in which rod feedstock is gripped in a channel formed between one moving surface defined by the walls of a groove in a rotatable wheel and a stationary shoe closing part of the circumference of the groove and having a stop at the end towards which the moving surface travels, to advance the feedstock towards the stop and so develop a pressure in the feedstock greater than the yield strength of the material from which it is made so that it upsets against the stop and flows out through a die forming an orifice that extends through the stationary shoe at the closed end of the channel, and in which lubricant is applied selectively to a side of the feedstock that will contact the stationary shoe.

The invention also includes a machine for continuous friction-effected extrusion of rod feedstock comprising a wheel, means for rotating said wheel in a predetermined direction about said axis, said wheel having walls defining a groove extending circumferentially around the wheel's perimeter and concentric with said axis, said walls defining a moving surface, a stationary shoe closing part of the circumference of said groove to form a channel between said moving surface and said stationary shoe and including a stop closing the end of the channel towards which the moving surface travels, a die forming an orifice that extends through said stationary shoe at said closed end, means for guiding rod feedstock into said channel, and means for applying lubricant selectively to a side of the feedstock that will contact said stationary shoe.

Since the lubricant must be confined to the surface of the feedstock that is to contact the shoe, or to part of that surface, the lubricant is preferably substantially solid, at least when applied, and wax is preferred. Consistent application of a controlled amount of wax or other lubricant is important and when applying wax by rubbing a wax stick on the feedstock there is a risk that the stick may be so heated by friction that melting occurs and wax may get onto the side that contacts the moving surface bringing extrusion to a standstill; and with conventional application techniques it has been found necessary for getting even rubbing pressure and so uniform coating, to straighten and guide the feedstock with much greater precision than would otherwise be required; preferably, to overcome this problem, the wax or other suitable fusible solid lubricant is applied by supporting a stick of the lubricant in a cylinder having an open end facing the side of the feedstock that will contact the shoe, in which cylinder the stick is a loose sliding fit, and introducing compressed air (or other gas) into the cylinder to apply a substantially constant biassing force urging the stick into engagement with the said side and at the same time (by leaking between the stick of lubricant and the cylinder) to cool the stick of lubricant to inhibit melting.

Preferably there are two cylinders to allow rapid deployment of a fresh stick of lubricant in place of one that is or is about to be exhausted.

The sticks of lubricant, and consequently the cylinders, may be of circular, rectangular or other suitable cross-section.

A further benefit of this type of applicator is that there is little friction between the cylinder and the lubricant stick and so the force applied can by very finely controlled.

Figure 2:
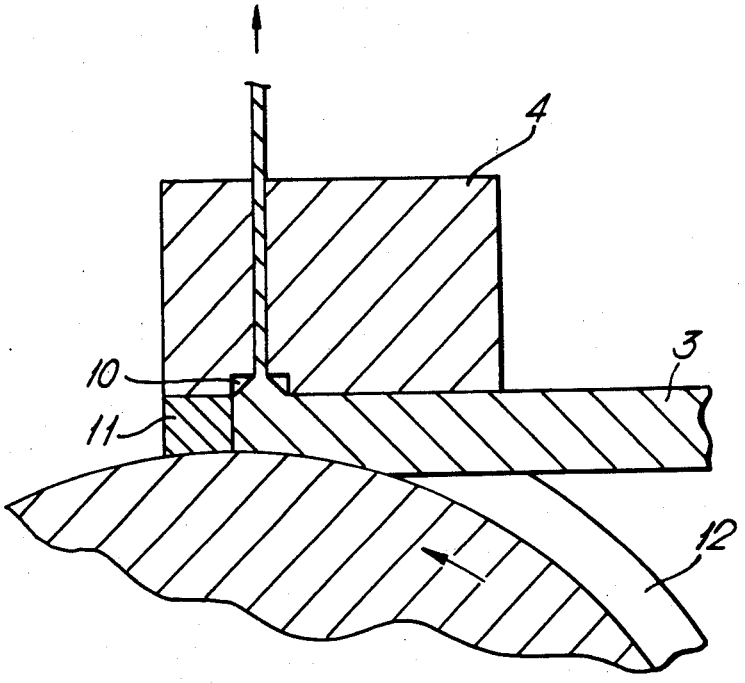

The invention is now described with reference to, and as shown in, the accompanying drawings in which:

FIG. 1 is a diagrammatic perspective view of one form of apparatus in accordance with the invention; and FIG. 2 is a diagrammatic partial cross-sectional view of the "Conform" apparatus.

Referring to FIG. 1, wax in the form of a stick 1 is applied to the side 2 of the rectangular feedstock 3 that contacts the shoe 4 of a "Conform" extrusion apparatus (shown diagrammatically in FIG. 1 and in partial cross-section in FIG. 2, which shows a die 10, a stop 11, and a wheel 12) before the feedstock is fed to the extrusion apparatus. The sticks 1 of wax are supported by and are a loose sliding fit in open-ended cylinders 5,6.

Compressed air is fed via pipes 7 and a two-way valve 8 to one of the cylinders, as shown cylinder 5. The air supplies a constant biassing force urging the stick 1 of wax into engagement with the side 2 and at the same time leaks between the stick 1 of wax and the cylinder 5 to cool the wax to inhibit melting.

When a stick 1 of wax in cylinder 5 is exhausted the stick 1 of wax in cylinder 6 is rapidly brought into use by turning the two-way valve 8. A fresh stick 1 of wax can then be inserted in cylinder 5 by unscrewing a cap 9 at the closed end of the cylinder 4 at any time before it is required by exhaustion of the stick in cylinder 6.

Although the drawing shows rectangular feedstock, this invention may also be applied to any other suitable cross-section of rod feedstock.

The invention gives greater flexibility in the design of the wheel groove and shoe of the Conform machine.

We claim:

1. A process for continuous friction-effected extrusion of rod feedstock in which rod feedstock is gripped in a channel formed between one moving surface defined by the walls of a groove in a rotatable wheel and a stationary shoe closing part of the circumference of the groove and having a stop at the end towards which the moving surface travels, to advance the feedstock towards the stop and so develop a pressure in the feedstock greater than the yield strength of the material from which it is made so that it upsets against the stop and flows out through a die forming an orifice that extends through the stationary shoe at the closed end of the channel, and in which lubricant is applied selectively to a side of the feedstock that will contact the stationary shoe by supporting a stick of the lubricant in a cylinder having an open end facing the said side of the feedstock that will contact the shoe, in which cylinder the stick is a loose fit and introducing compressed gas into the cylinder to apply a substantially constant biasing force urging the stick into engagement with the said side and at the same time to cool the stick of lubricant to inhibit melting.

2. A machine for continuous friction-effected extrusion of rod feedstock comprising:

a wheel rotatable in a predetermined direction about its axis, said wheel having wall defining a groove extending circumferentially around the wheels perimeter and concentric with said axis, said walls defining a moving surface;

a stationary shoe closing part of the circumference of said groove to form a feedstock-receiving channel between said moving surface and said stationary shoe and including a stop closing the end of the channel towards which the moving surface travels;

a die forming an orifice that extends through said stationary shoe at said closed end;

and means for applying lubricant selectively to a side of said feedstock that will contact said stationary shoe;

wherein said means for applying lubricant comprises at least one cylinder means having an open end facing the said side of the feedstock when the machine is in use and means for introducing compressed gas in said cylinder means.

3. A machine as claimed in claim 2 having two cylinder means, in which said means for introducing compressed gas comprises a valve, said valve introducing compressed gas to each said cylinder means in turn.

* * * * *